United States Patent [19]

Birds, Jr.

[11] 4,363,726

[45] Dec. 14, 1982

[54] ORE CONCENTRATOR

[76] Inventor: George J. Birds, Jr., 39148 Canyon Dr., Lebec, Calif. 93243

[21] Appl. No.: 267,635

[22] Filed: May 27, 1981

[51] Int. Cl.[3] ..... B03B 5/74

[52] U.S. Cl. ..... 209/436; 209/445; 209/503

[58] Field of Search ..... 209/434–436, 209/444, 445, 451, 453, 485, 508, 503–505

[56] References Cited

U.S. PATENT DOCUMENTS

| | | | |
|---|---|---|---|
| 414,706 | 11/1889 | Hooper | 209/445 |
| 632,075 | 8/1899 | Waters | 209/441 |
| 711,903 | 10/1902 | Look | 209/436 |
| 906,205 | 12/1908 | Darrow | 209/489 |
| 987,866 | 3/1911 | Earle | 209/445 |
| 1,126,818 | 2/1915 | Michaelsen | 209/160 |
| 1,141,972 | 6/1915 | Muhleman | 209/439 |
| 1,985,513 | 12/1934 | McCleery | 209/444 X |
| 1,985,514 | 12/1934 | McCleery | 209/445 X |
| 1,986,778 | 1/1935 | Hinkley | 209/444 X |
| 2,064,554 | 12/1936 | Mahoney et al. | 209/452 |
| 4,267,036 | 5/1981 | Kleven | 209/444 |

OTHER PUBLICATIONS

California Mining Journal, Apr., 1981, p. 59.

*Primary Examiner*—Ralph J. Hill
*Attorney, Agent, or Firm*—Max E. Shirk

[57] ABSTRACT

A spiral-type ore concentrating wheel has a plurality of interleaved, spiral bands tapering in height uniformly from the periphery of the wheel to its central, discharge aperture for moving concentrates to the aperture while the wheel is oscillated back-and-forth during advancement thereof in a predetermined rotated direction.

5 Claims, 7 Drawing Figures

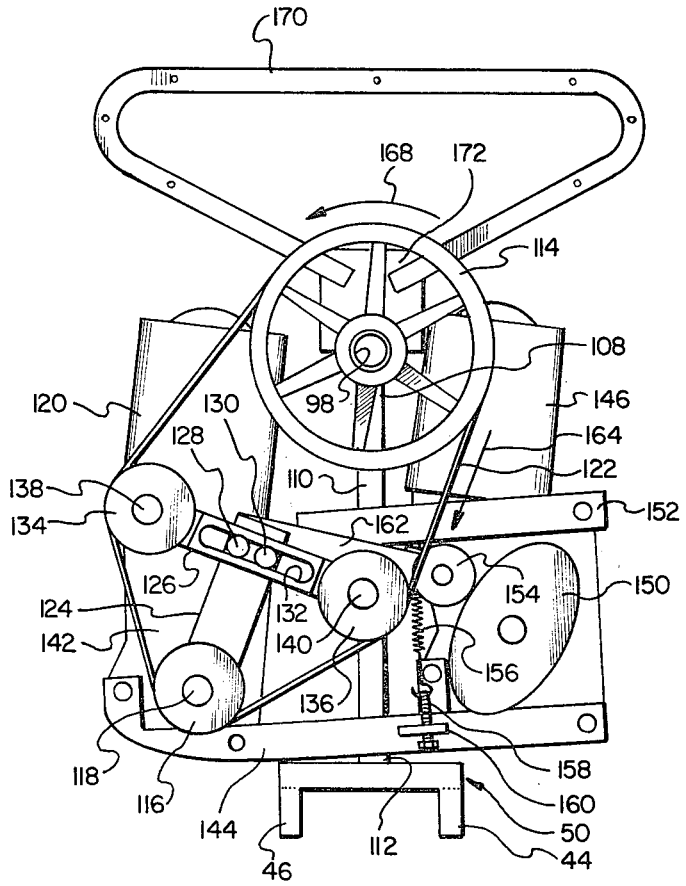
Fig.6.
Fig.7.
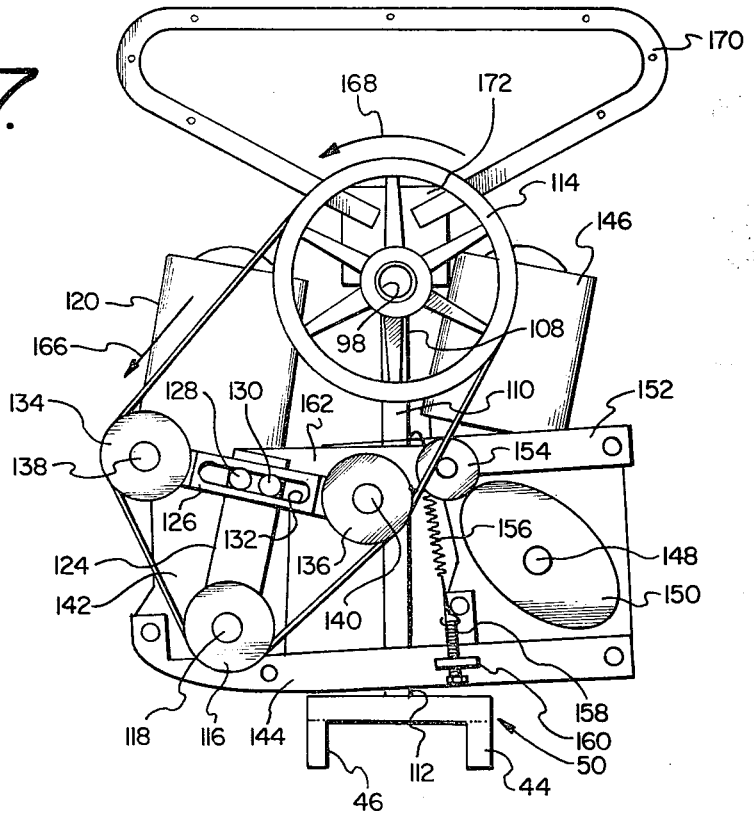

ORE CONCENTRATOR

BACKGROUND OF THE INVENTION

Field of the Invention

The present invention pertains generally to the field of ore concentrators and more particularly to a new and useful ore concentrator of the spiral type.

SUMMARY OF THE INVENTION

The present invention is directed, in brief, to the provision of a novel ore-concentrating wheel or pan and drive system.

The best mode currently contemplated for carrying out the invention includes the provision of an ore concentrator including a pan having an encompassing sidewall, a bottom wall and a central aperture, a mechanism coupled to the pan for imparting rotation thereto and a band spiraling inwardly from the sidewall to the aperture for advancing concentrates from the sidewall to the aperture during rotation of the pan.

The band may decrease uniformly in height from the sidewall to the aperture and a plurality of such bands may be interleaved to increase the capacity of the concentrator.

The concentrator may also include a device for oscillating the pan back-and-forth in conjunction with the concentrate-advancing rotation.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which like reference characters refer to like elements in the several views.

BRIEF DESCRIPTION OF THE DRAWINGS

FIG. 6 is an enlarged partial rear-elevational view of the device of FIG. 1 showing certain portions thereof in a first operating position; and FIG. 7 is a view similar to FIG. 6 with the parts in a second operating position.

DESCRIPTION OF THE PREFERRED EMBODIMENT

Figure 1:
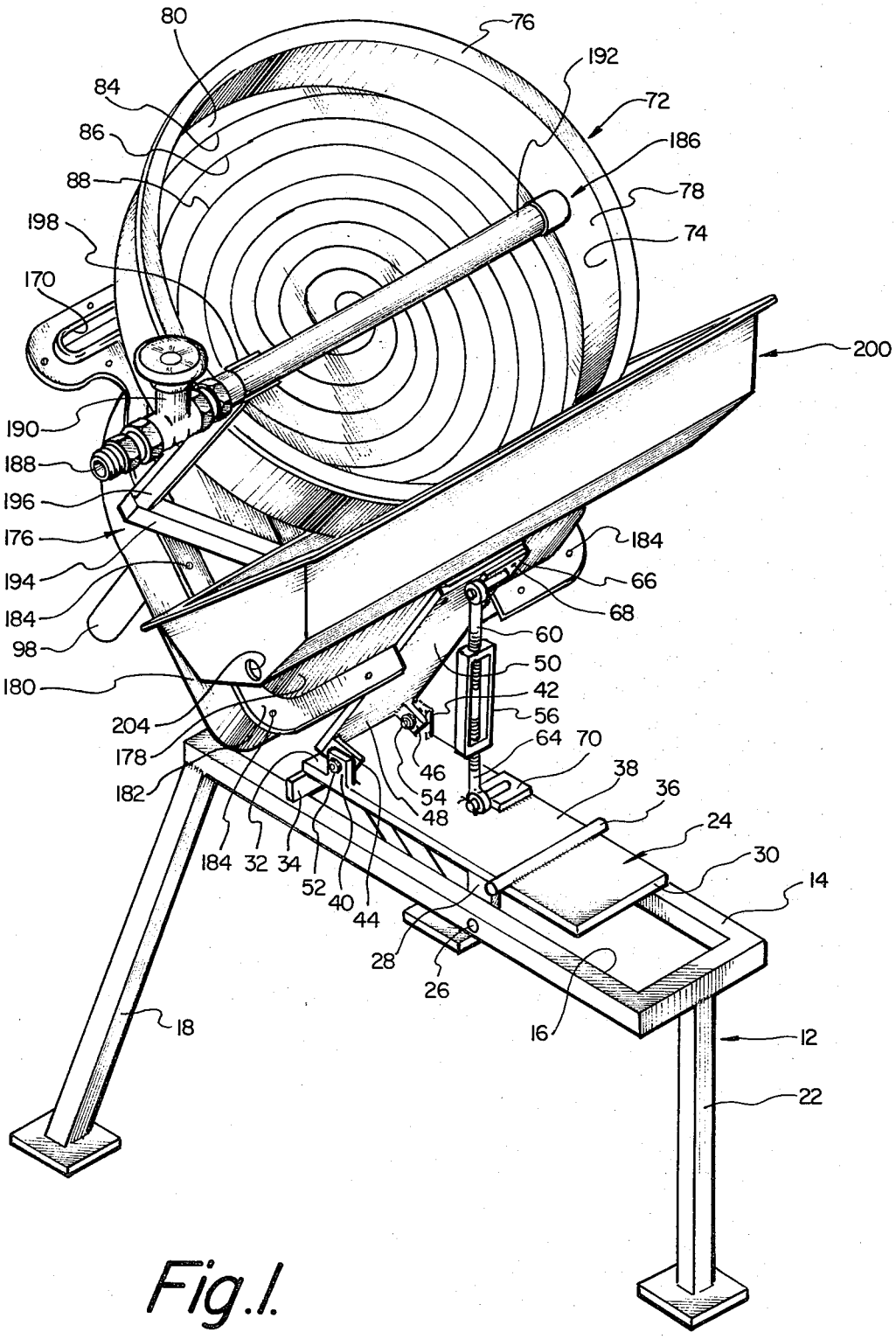
FIG. 1 is a perspective view of an ore concentrator constituting a presently-preferred embodiment of the invention.
Figure 2:
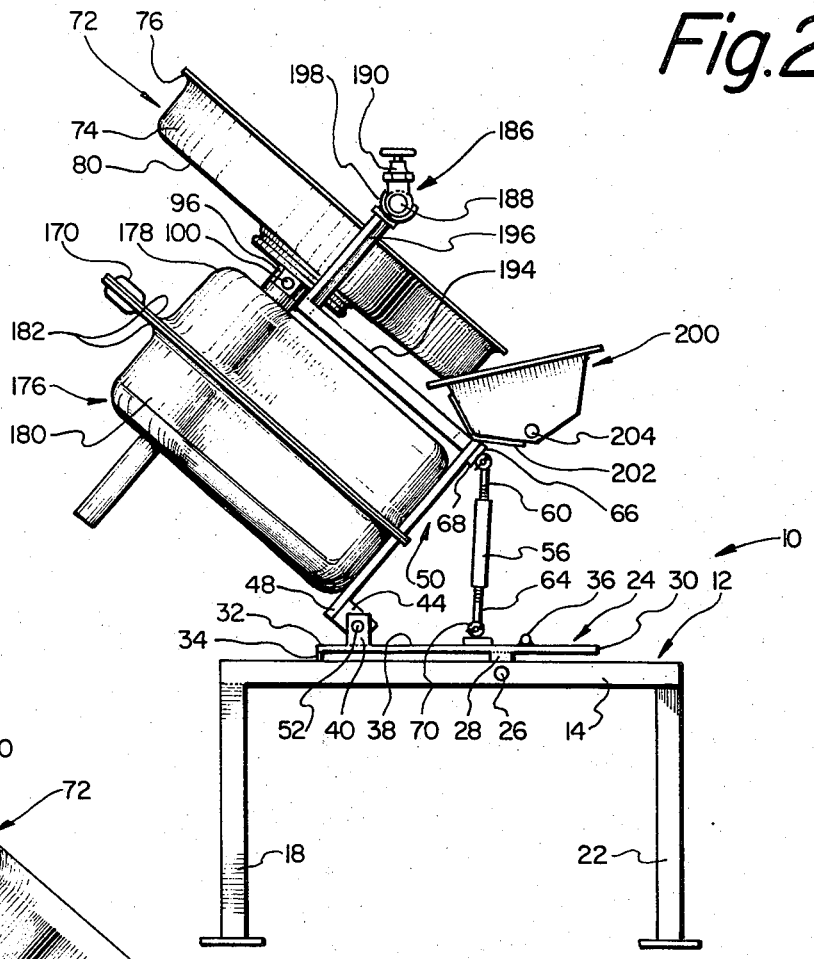
FIG. 2 is a reduced, side-elevational view of the device of FIG. 1.

Referring again to the drawings, and more particularly to FIGS. 1 and 2, an ore concentrator constituting a presently-preferred embodiment of the invention, generally designated 10, comprises a stand 12, including a planar member 14 having an elongated opening 16 provided therein and a plurality of legs 18, 20, 22 depending from planar member 14 for supporting stand 12. A base plate 24 is swingably mounted in opening 16 by a first pivot pin 26 and a second pivot pin (not shown) engaging planar member 14 and a first mounting lug 28 and a second mounting lug (not shown), respectively, depending from base plate 24 intermediate its front end 30 and its rear end 32. A first stop member 34 is affixed to rear end 32 and engages planar member 14 to normally maintain base plate 24 in the operating position shown in FIGS. 1 and 2. Base plate 24 may be prevented from rotating clockwise (as viewed in FIG. 2) more than a predetermined amount, for a purpose to be hereinafter explained, by a second stop member 36 which is affixed to the upper surface 38 of base plate 24 intermediate front end 30 and the first mounting lug 28.

Base plate 24 includes third and fourth lugs 40 and 42, respectively, which extend upwardly from surface 38 for coacting with fifth and sixth lugs 44 and 46, respectively, which depend from the lower end 48 of a bracket member 50. Third and fourth pivot pins 52, 54 pivotably connect the fifth mounting lug 44 to the third mounting lug 40 and the sixth mounting lug 46 to the fourth mounting lug 42, respectively, for swingably connecting bracket member 50 to base plate 24.

Bracket member 50 may be maintained at predetermined angles with respect to base plate 24 by a turnbuckle 56 including a first eye bolt 60 and a second eye bolt 64. Eye bolt 60 is connected to the upper end 66 of bracket member 50 by a first pin-and-plate assembly 68 and the second eye bolt 64 is connected to base plate 24 by a second pin-and-plate assembly 70.

Referring now to FIGS. 1–5, ore concentrator 10 also comprises a spiral separating wheel or pan 72 including an encompassing sidewall 74 having an upper, annular, outwardly-extending lip 76, an open top 78, a bottom wall 80, provided with a central discharge aperture 82, and a plurality of upstanding, interleaved bands 84, 86, 88 spiraling inwardly from sidewall 74 to aperture 82. Each band is preferably made of stainless steel, is approximately fifty thousandths of an inch thick, ½ inch wide and decreases in height from about ¼ inch at the periphery of pan 72 to approximately 1/6 inch at aperture 82.

Pan 72 includes an upper ply 90 and a lower ply 92 (FIG. 3) both made from a suitable polycarbonate material by vacuum-forming techniques. A suitable fixture and plug (not shown) may be employed to hold bands 84, 86, 88 in proper positions while upper ply 90 is drawn in a manner such that bands 84, 86, 88 are imbedded in ply 90 and aperture 82 is formed by material forming around the plug to form the funnel shown at 94 in FIG. 3. The outer surface of ply 90 is then coated with a suitable solvent cement, such as methylchloride, a hub 96 (carried by a pulley for convenience) is positioned over funnel 94 and the second ply 92 is drawn into intimate engagement with the outer surfaces of ply 90, hub 96 and the portions of bands 84, 86, 88 covered by ply 90.

Concentrator 10 includes a hollow shaft 98, which is rigidly coupled to hub 96 by a set-screw 100 (FIG. 3) and is supported in a sleeve 102 by a pair of brass bushings 104, 106. Sleeve 102 is secured parallel by a weld 107 to the upper end 108 of a rectangular support member 110 having a lower end 112 (FIGS. 6 & 7) secured to bracket member 50 for supporting support member 110 at a right angle to bracket member 50, whereby shaft 98 lies parallel to bracket member 50.

Referring now to FIGS. 6 and 7, shaft 98 may be rotated by a driven pulley 114 which is driven by a drive pulley 116, keyed to the output shaft 118 on a first motor 120, and a belt 122 trained about pulleys 114 and 116. A first bar 124 has its lower end pivoted with a brass bushing on output shaft 118 and has a second bar 126 coupled to its upper end. A pair of bolts 128, 130 engaged in a slot 132 provided in bar 126 provide belt tensioning by allowing pulleys 134 and 136 to be spread. First and second idler pulleys 134, 136 are rotatably mounted on the first and second ends 138, 140 of bar 126, respectively, and are engaged by belt 122. Motor 120 includes a gearbox housing 142 mounted to a bracket 144 which, in turn, is mounted to the rectangular support member 110, whereby motor 120 is supported by bracket member 50.

Concentrator 10 also includes a second motor 146 having a second output shaft 148 to which an elliptically-shaped cam 150 is keyed. Motor 146 may be of the same type as motor 120 and is mounted to support member 110 by bracket 144 and a second bracket 152. Cam 150 transmits a force to a cam follower 154 which may be a ball bearing and which is biased into engagement with cam 150 by a spring 156 having one end adjustably connected to a threaded bracket 160 (forming part of bracket 144) by a bolt 158. The other end of spring 156 is connected to a lever 162 to one end of which cam follower 154 is mounted. The other end of lever 162 is mounted to the upper end of bar 124, whereby cam 150, spring 156 and lever 162 will oscillate bar 124 in inverted-pendulum fashion when motor 146 is energized.

Assuming that motor 120 is not energized and that motor 146 is energized, idler 136 will cyclically pull belt 122 slightly in a clockwise direction, as indicated by arrow 146 in FIG. 6, while idler 134 simultaneously permits belt 122 to slacken. Additionally, idler 134 will cyclically pull belt 122 slightly in a counterclockwise direction, as indicated by arrow 166 in FIG. 7, while idler 136 simultaneously permits belt 122 to slacken. Since drive pulley 116 is stationary, this cyclical slackening and tightening of belt 122 on each side of pulley 114 oscillates pulley 114, shaft 98 and pan 72.

Assuming, on the other hand, that motor 120 is also energized with drive pulley 116 rotating driven pulley 114 in a counterclockwise direction (looking from the back), as indicated by arrow 168, pan 72 will cyclically receive forward and reverse lashes of approximately 1 inch while it is being advanced clockwise (looking from the front).

Motors 120 and 146 may each comprise a 12-volt, direct-current motor with variable speed control.

Figure 3:
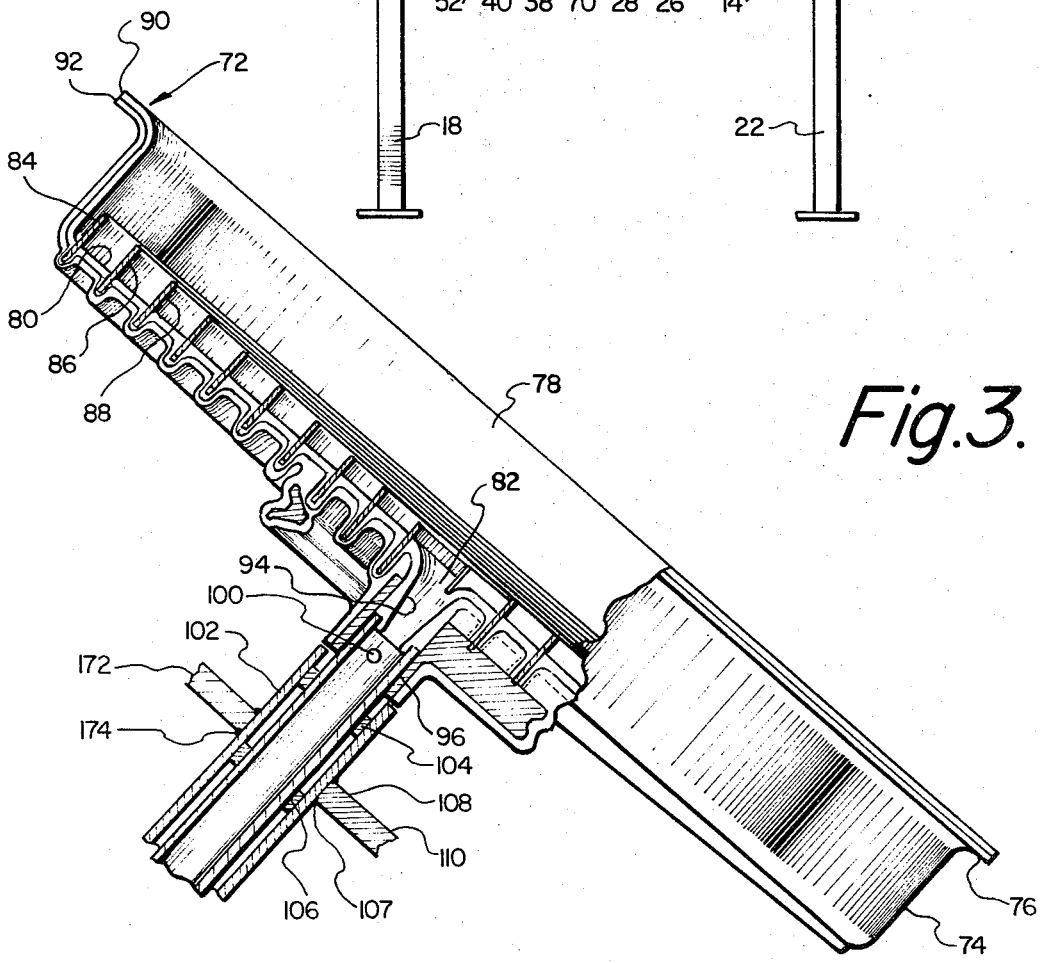
FIG. 3 is an enlarged, side-elevational view, with parts broken away and portions shown in cross section, of a spiral pan forming part of the device of FIG. 1.
Figure 4:
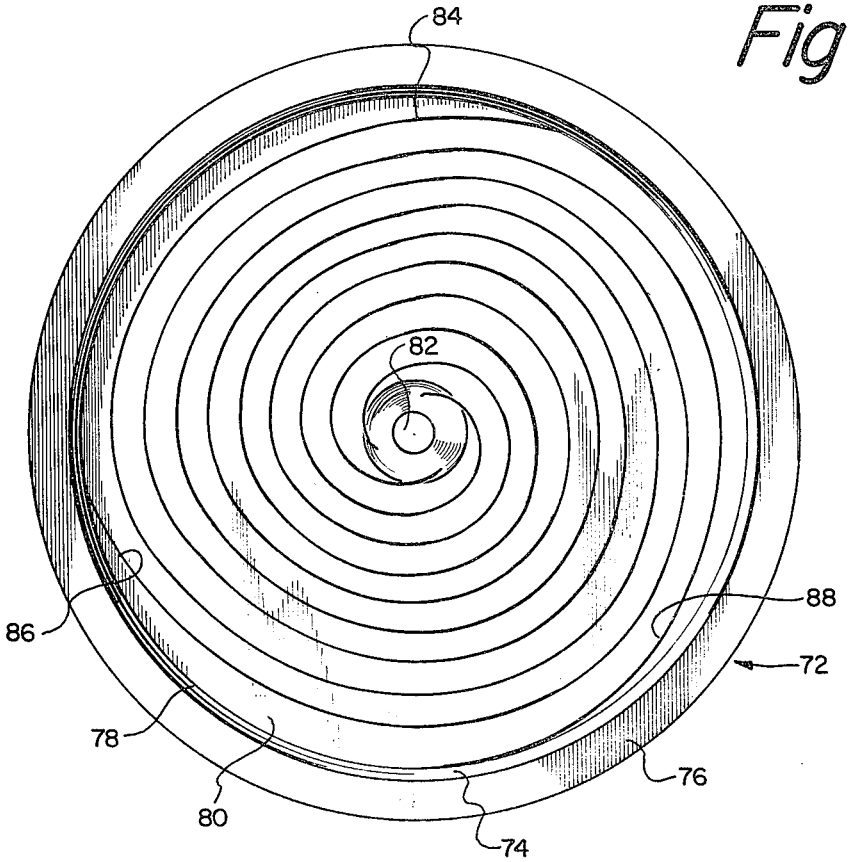
FIG. 4 is a top plan view of the pan of FIG. 3.

Referring now to FIGS. 3, 6 and 7, concentrator 10 also includes a carrying handle 170 mounted to a plate 172 which is affixed at right angles to the top of sleeve 102 by a weld 174 (FIG. 3).

Figure 5:
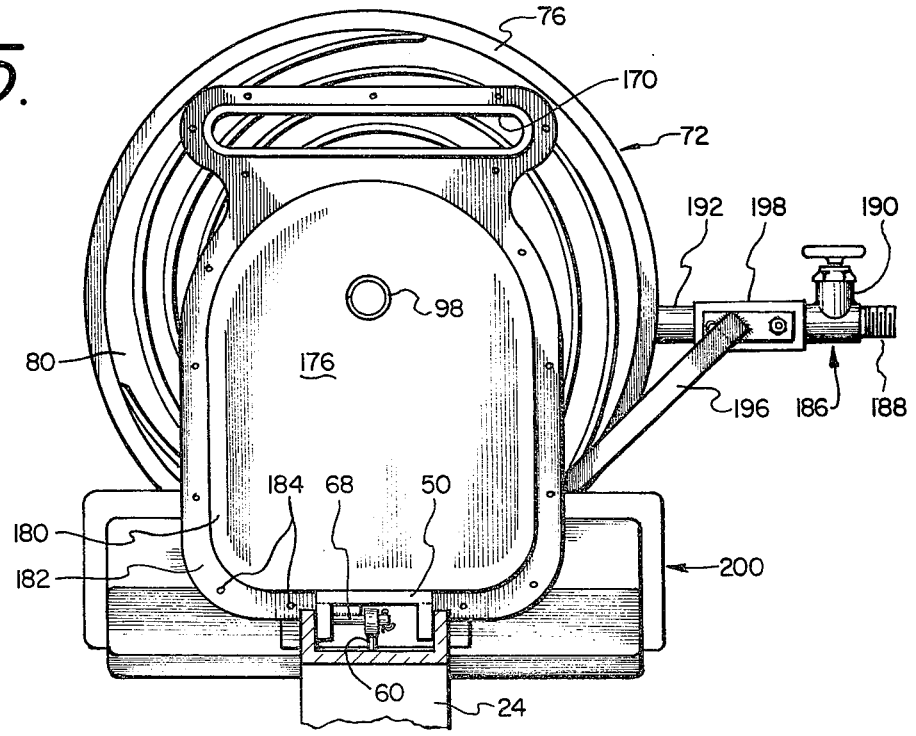
FIG. 5 is a reduced, partial bottom plan view of the device of FIG. 1.

As best seen in FIGS. 1, 2 and 5, carrying handle 170 and the moving mechanisms on concentrator 10 may be housed in a housing 176 including an upper housing portion 178 and a lower housing portion 180 each having an encompassing flange 182 joined together by a plurality of fasteners 184.

Water may be supplied to pan 72 by a water-supply system 186 including a water inlet 188, a control valve 190 and a water-distribution pipe 192. Water-supply system 186 may be mounted to bracket 50 by first support member 194 having a lower end affixed to bracket 50 and an upper end to which one end of a second support member 196 is affixed. The other end of support member 196 carries a saddle 198 to which pipe 192 is mounted.

Water and tailings leaving pan 72 may be collected in a trough 200 mounted to bracket 50 by a saddle 202 (FIG. 2). Trough 200 is provided with an outlet 204 which may be connected to a sump (not shown) for settling the tailings so that the water may be recirculated to water inlet 188.

Operation of concentrator 10 is believed to be apparent from the foregoing and will be briefly summarized at this point.

Turnbuckle 56 may be adjusted to position pan 72 at a suitable angle, depending on the nature of the ore being fed to pan 72. Placing the plane of bottom wall 80 approximately 45 degrees from the vertical has been found to be satisfactory. Concentrator 10 approximates the motions of a gold pan with cam 150 oscillating wheel 72 back and forth while motor 120 advances it at the same time. This allows the dynamic surface friction on wheel 72 to be broken up into sections and lets the ore settle down low on sidewall 74. It also introduces static friction which tends to keep the ore low on the wheel. Water flow requirements are lessened to wash the light material down and out of wheel 72 into trough 200. The mass of ore in the bottom of the wheel is in a settling condition and jiggling in a stable mass allowing the light material to rise to the surface and wash over lip 76 by the gentle flow of water. The "heavys" naturally settle to the bottom of any container, and in this case, a rising groove, namely spiral bands 84, 86 88 pick up these "heavys" and carry them up until the grooves end at aperture 82 from whence the "heavys" exit pan 72 through hollow shaft 90. By oscillating spiral wheel 72 a rolling action of the ore is lessened. This rolling or mixing up of the "heavys" and "lights" in the cup of the spiral wheel is not desirable and even less desirable when fine flakes or flour gold is present.

The keen edge of each stainless steel spiral gives a very smooth and fine action in its separation. Additionally, the tapering of each spiral from ¼ inch at the periphery to 1/16 inch at aperture 82 makes pan 72 cut the ore finer and cleaner.

Wheel 72 may fail to cut clean concentrates when the upper bands become partially filled with concentrates. The "lights" start up the wheel and cause a contaminated concentrate. This condition indicates that more ore must be added to provide more "heavys" for the upper spirals to be filled. If the added ore's "heavys" still do not fill the upper spirals, magnetic black sand may be added to continue the wheel's clean concentrating. This black sand may then be removed magnetically for re-use.

Using cam 150 and its associated parts to oscillate pan 72, a low volume water supply and uniform ore feed, the percentage of recovery can be increased. The ore is preferably sized to not more than one-eighth of an inch before being placed on the wheel. The ore may be in a wet slurry as it is placed on the wheel, preferably a small amount every few seconds through a wet ore feeder.

While the particular ore concentrator herein shown and described in detail is fully capable of attaining the objects and providing the advantages hereinbefore stated, it is to be understood that it is merely illustrative of the presently-preferred embodiment of the invention and that no limitations are intended to the details of construction or design herein shown other than defined in the appended claims, which form a part of this disclosure.

Whenever the term "means" is employed in these claims, this term is to be interpreted as defining the corresponding structure illustrated and described in this specification or the equivalent of the same.

What is claimed is:

1. In combination with an ore concentrator including a pan having an encompassing sidewall, a bottom wall and a central aperture in said bottom wall, means coupled to said pan for imparting rotation thereto and means upstanding from said bottom wall for advancing concentrates from said sidewall to said central aperture during rotation of said pan, the improvement wherein said rotation imparting means includes means for oscillating said pan back-and-forth circumferentially.

2. In combination with an ore concentrator including a pan having an encompassing sidewall, a bottom wall and a central aperture in said bottom wall, means coupled to said pan for imparting rotation thereto and means upstanding from said bottom wall for advancing concentrates from said sidewall to said central aperture during rotation of said pan, the improvement wherein said rotation imparting means includes means for oscillating said pan back-and-forth circumferentially, said means for imparting rotation to said pan and said means for oscillating said pan comprising:

a first motor having a first output shaft;

a first pulley keyed to said first output shaft;

a second pulley keyed to said pan;

a drive belt trained about said first and second pulleys for rotating said pan;

a first bar having first and second ends, one of said first and second ends being pivotably mounted on said first output shaft;

a second bar having first and second ends and an intermediate portion, said intermediate portion being affixed to the other of said first and second ends of said first bar with the major axis of said first bar lying normal to the major axis of said second bar;

a third pulley rotatably mounted on said first end of said second bar;

a fourth pulley rotatably mounted on said second end of said second bar, said third and fourth pulleys engaging said drive belt for rotation thereby;

a second motor having a second output shaft; and means coupling said second output shaft to said first bar for oscillating said first bar back-and-forth, whereby said drive belt is cyclically tensioned and relaxed by said third and fourth pulleys for oscillating said pan back-and-forth.

3. An improvement as stated in claim 2 wherein said means coupling said second output shaft to said first bar comprises:

an elliptically-shaped cam keyed to said second output shaft:

a cam follower affixed to said first bar; and a spring biasing said cam follower into engagement with said cam.

4. An ore concentrator, comprising:

a stand including a planar member having an elongated opening provided therein and a plurality of legs depending from said planar member for supporting said stand;

a base plate including a front end, a rear end, first and second mounting lugs depending from said base plate intermediate said ends, third and fourth mounting lugs upstanding from said base plate adjacent said rear end and a first stop member affixed to the rear end of said base plate for supporting said rear end on said planar member;

first and second pivot pins swingably connecting said first and second mounting lugs, respectively, to said planar member for supporting said base plate in said opening;

a second stop member affixed to said base plate intermediate said front end and said first and second lugs for engaging said planar member after said base plate has swung about said first and second pivot pins a predetermined amount;

a bracket member including an upper end, a lower end and fifth and sixth mounting lugs depending from said lower end;

third and fourth pivot pins pivotably connecting said fifth mounting lug to said third mounting lug and said sixth mounting lug to said fourth mounting lug, respectively;

a turnbuckle connecting said upper end of said bracket member to said base member for maintaining said bracket member at a desired angle with respect to said base member;

a rectangular support member upstanding from said bracket member normal thereto, said support member having an upper end and a lower end;

an ore concentrating pan having an encompassing sidewall, an open top, a bottom wall, a central aperture provided in said bottom wall and at least one band spiraling inwardly from said sidewall to said aperture;

a hollow shaft rigidly coupled to said pan aperture, said shaft being rotatably mounted to said upper end of said support member parallel thereto;

a driven pulley keyed to said hollow shaft;

a first motor mounted to said support member, said first motor having a first output shaft;

a drive pulley keyed to said first output shaft;

a first bar having first and second ends, one of said first and second ends being pivotably mounted on said first output shaft;

a second bar having first and second ends and an intermediate portion, said intermediate portion being affixed to the other of said first and second ends of said first bar with the major axis of said first bar lying normal to the major axis of said second bar;

a first idler pulley rotatably mounted on said first end of said second bar;

a second idler pulley rotatably mounted on said second end of said second bar;

a drive belt trained about said drive, driven and idler pulleys for rotating said pan in a predetermined direction;

a second motor mounted to said support member, said second motor having a second output shaft; and means coupling said second output shaft to said first bar for oscillating said first bar back-and-forth, whereby said drive belt is cyclically tensioned and relaxed by said idler pulleys for oscillating said pan back-and-forth, said coupling means comprising:

an elliptically-shaped cam keyed to said second output shaft;

a cam follower affixed to said first bar; and a spring biasing said cam follower into engagement with said cam.

5. An ore concentrator, comprising:

a frame;

a pan having at least one spiral riffle coiled inwardly from the periphery of said pan to an opening provided in the center thereof;

a hollow shaft coupled to said opening;

means rotatably mounting said hollow shaft to said frame;

a driven pulley coupled to said hollow shaft for imparting rotation to said pan;

a drive pulley rotatably mounted to said frame for driving said driven pulley;

a belt trained about said pulleys for transmitting rotation from said drive pulley to said driven pulley; and means mounted to said frame for cyclically pulling said belt alternately in clockwise and counterclockwise directions, whereby said pan will be oscillated radially.

* * * * *